US006255628B1

(12) United States Patent
Perrino

(10) Patent No.: US 6,255,628 B1
(45) Date of Patent: Jul. 3, 2001

(54) BURNER APPARATUS

(75) Inventor: Joseph M. Perrino, 1210 Morst Pass, Wyoming, OH (US) 45215

(73) Assignee: Joseph M. Perrino, Wyoming, OH (US)

( * ) Notice: Subject to any disclaimer, the term of this patent is extended or adjusted under 35 U.S.C. 154(b) by 0 days.

(21) Appl. No.: 09/608,782

(22) Filed: Jun. 30, 2000

(51) Int. Cl.[7] ..... H05B 3/68; F24C 3/00

(52) U.S. Cl. ..... 219/468.1; 219/452.11; 126/39 J

(58) Field of Search ..... 219/451.1, 452.11, 219/460.1, 465.1, 468.1; 126/39 H, 39 N, 39 J, 39 K, 39 M, 90 A, 92 AC, 92 A

(56) References Cited

U.S. PATENT DOCUMENTS 3,375,346 * 3/1968 Gaugler et al. ..... 219/448.11
3,830,216 * 8/1974 Dodd ..... 126/39 J
4,580,550 * 4/1986 Kristen et al. ..... 126/39 J
5,571,434 * 11/1996 Cavener et al. ..... 219/452.12
5,847,364 * 12/1998 White et al. ..... 219/452.12
6,111,229 * 8/2000 Schultheis ..... 219/452.11

* cited by examiner

*Primary Examiner*—Sang Paik

(57) ABSTRACT

The present invention is directed to a new and novel burner apparatus for use with electric or gas ranges; that is relatively easy to clean and maintain; that can provide a heating surface that can accommodate various sizes of cooking vessels; is relatively inexpensive to manufacture and maintain; is relatively durable and simple in construction; and easy to install on conventional stoves and ranges. In a preferred embodiment of the invention, the burner apparatus comprises a heating surface and a magnetic means for securing the burner apparatus in position on the cooking range. In another preferred embodiment of the invention, the burner apparatus includes an electric heating element. In another preferred embodiment of the invention, the burner apparatus cooperates with a gas heating element.

21 Claims, 8 Drawing Sheets

BURNER APPARATUS

BACKGROUND OF THE INVENTION

The present invention is directed to a burner apparatus and more specifically, to a new and novel burner apparatus that can be used on a gas or electric range to prepare food.

Various heating methods have been used for preparing food and we call attention to those gas and electric ranges that have a plurality of openings in their cook top where they have a gas or electric heating element positioned to heat the contents of a cooking vessel. These openings leave the range or stove interior and their elements at risk. When a spill occurs on such a gas or electric range the liquid or food of the spill can fall into the opening, onto the heating elements and also enter the range or stove interior. On a gas range the spill can extinguish the flame and clog the gas jets. On an electric range the spill can cause damage to the wiring and electrical contacts. Cleaning the elements and the interior of either range is difficult.

Accordingly, there exists a need for a new and novel burner apparatus that can be used with a gas or electric cooking range; that is relatively easy to clean and maintain; that can provide a heating surface that can accommodate various sizes of cooking vessels; that permits the cooking of certain foods without the use of cooking vessels, that is securely positioned on the range surface, to seal and protect the range interior and its elements from spills.

SUMMARY OF THE INVENTION

The present invention is directed to a new and novel burner apparatus for use with gas or electric stoves and ranges. In a preferred embodiment of the invention, the burner apparatus comprises a heating surface and a magnetic means for securing the burner apparatus in position on the cooking stove or range.

In another preferred embodiment of the invention, the burner apparatus comprises a heating element.

In another preferred embodiment of the invention, the burner apparatus comprises more than one heating element.

In another preferred embodiment of the invention the burner apparatus is adapted for use with a gas range.

In another preferred embodiment of the invention the burner apparatus is adapted for use with an electric range.

In another preferred embodiment of the invention, the heating surface of the burner apparatus is substantially smooth and even.

In another preferred embodiment of the invention, the burner apparatus further comprises an upper heating surface having a non-stick material coating.

In another preferred embodiment of the invention, the burner apparatus is formed of ceramic material In another preferred embodiment of the invention, the burner apparatus further comprises means for preventing spillage from entering the basin of the range.

In another preferred embodiment of the invention, the burner apparatus further comprises means for regulating the temperature of the upper surface of said burner apparatus.

In another preferred embodiment of the invention, the burner apparatus further comprises a metal grid for improving the transfer of heat across the upper surface of said burner apparatus.

In another preferred embodiment of the invention, the burner apparatus is formed of a ceramic material having metal strands, flakes or shavings incorporated in the ceramic material for improving heat transfer throughout the burner apparatus.

A primary object of the present invention therefore, is to provide a new and novel burner apparatus for use with a gas or an electric range.

Another primary object of the present invention is provide a new and novel burner apparatus for use with a gas or an electric range that can provide a heating surface that can accommodate various number and sizes of cooking vessels.

Another primary object of the present invention is to provide a new and novel burner apparatus for use with a gas or an electric range that permits the cooking of certain foods without the use of a cooking vessel.

Another primary object of the present invention is to provide a new and novel burner apparatus for use with a gas or an electric range that is relatively inexpensive to manufacture.

Another primary object of the present invention is to provide a new and novel burner apparatus that is easy to install and use with a gas or an electric range.

Another primary object of the present invention is to provide a new and novel burner apparatus for use with an electric range that can replace the conventional electric burners.

These and other objects and advantages of the invention will be apparent from the following description, the accompanying drawings and the appended claims.

DETAILED DESCRIPTION OF PREFERRED EMBODIMENTS

Figure 1:
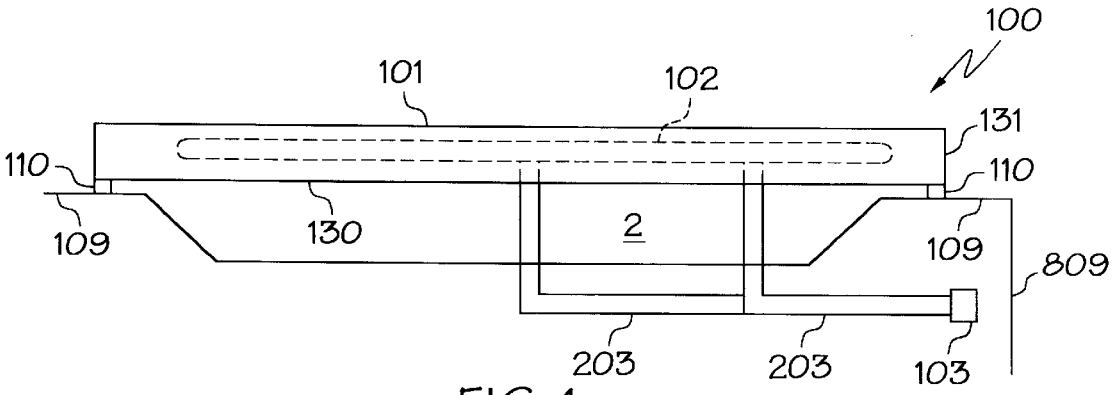
FIG. 1 is a side elevation of a burner apparatus of the present invention, securely situated on an electric range top, with an electric heating element encased between the upper planer surface and the lower surface of the burner apparatus and the connecting rods are extending down and to the side.
Figure 2:
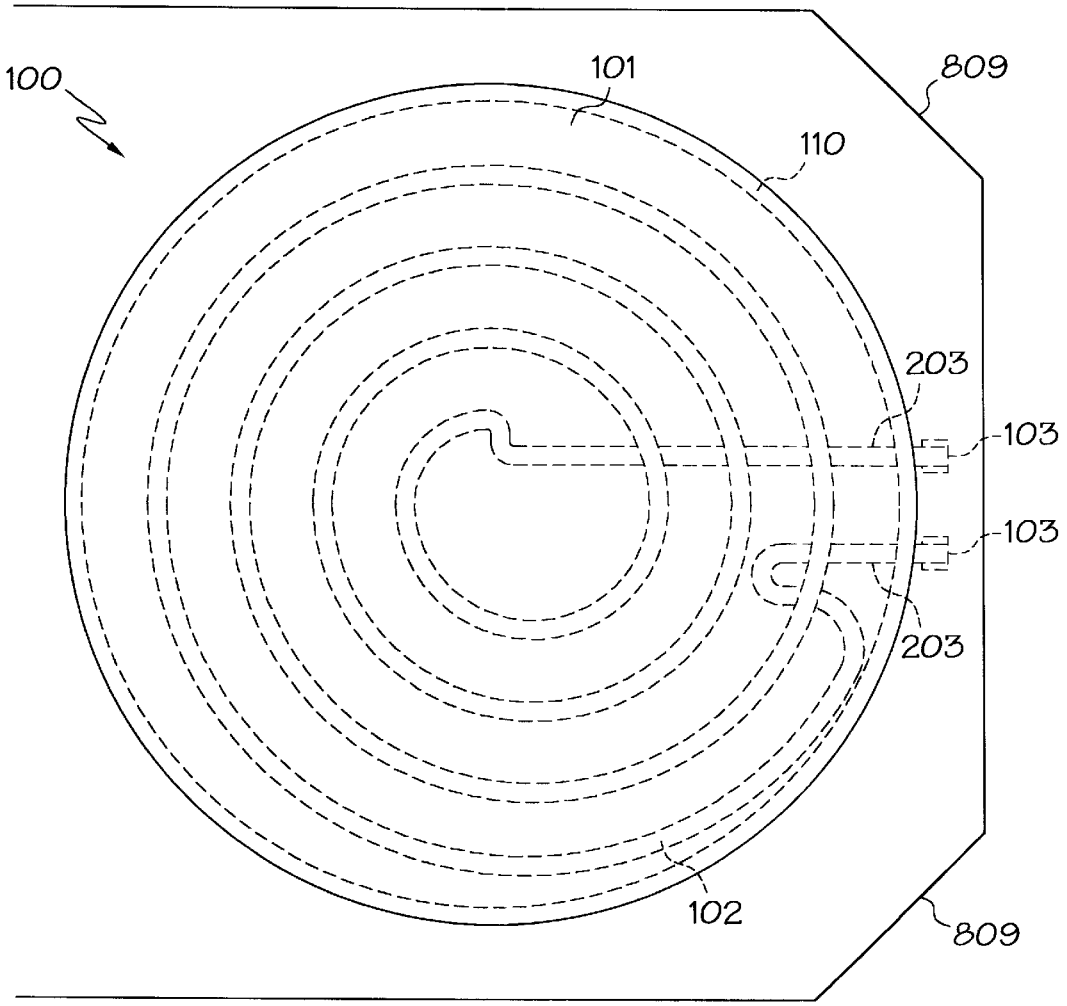
FIG. 2 is a perspective view of the upward facing side of FIG. 1.

Referring to FIGS. 1 and 2, a side and top view of a preferred embodiment of the burner apparatus 100 of the present invention which is designed to cook foods that are in a cooking vessel, not shown, that sits on the planar cooking surface 101. Comprised of a circular electric heating element 102, encased between the planar cooking surface 101 and the lower surface 130, with lead ins 203 and connecting prongs 103 attached, are extending down and to the side, to connect the heating element 102, to the electric range 809. A magnetic strip 110, attached to the bottom surface 130, at the peripheral edge 131, secures the burner apparatus 100 to the range surface 109 and seals and protects the rang,e interior 2 from spills.

Figure 3:
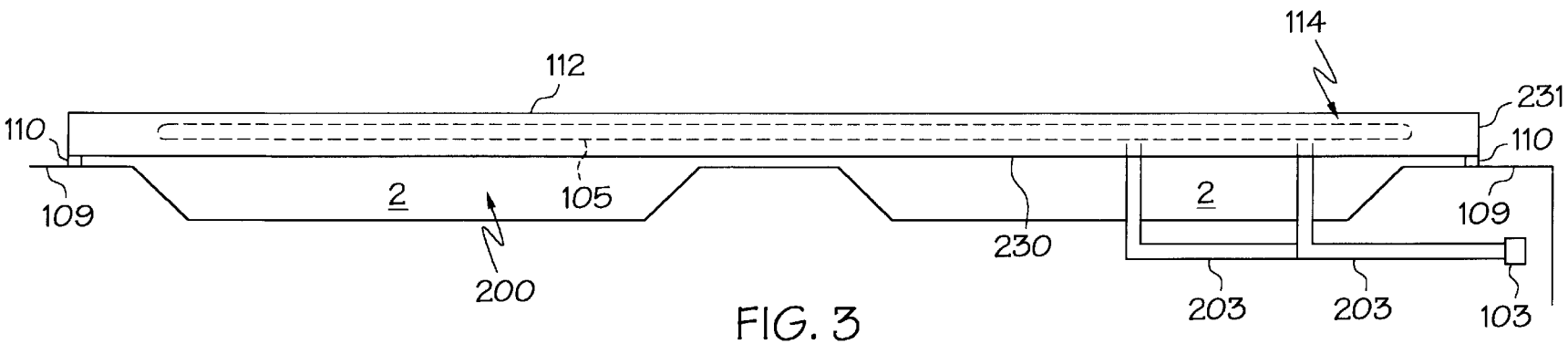
FIG. 3 is a side elevation of another preferred embodiment of the present invention, showing the burner apparatus securely situated on an electric top. An electric heating element is encased between the upper planer heating surface and the lower surface of the burner apparatus and the connecting rods are extending down and to the side. Designed as a griddle, the burner apparatus is depicted covering two range element openings.
Figure 4:
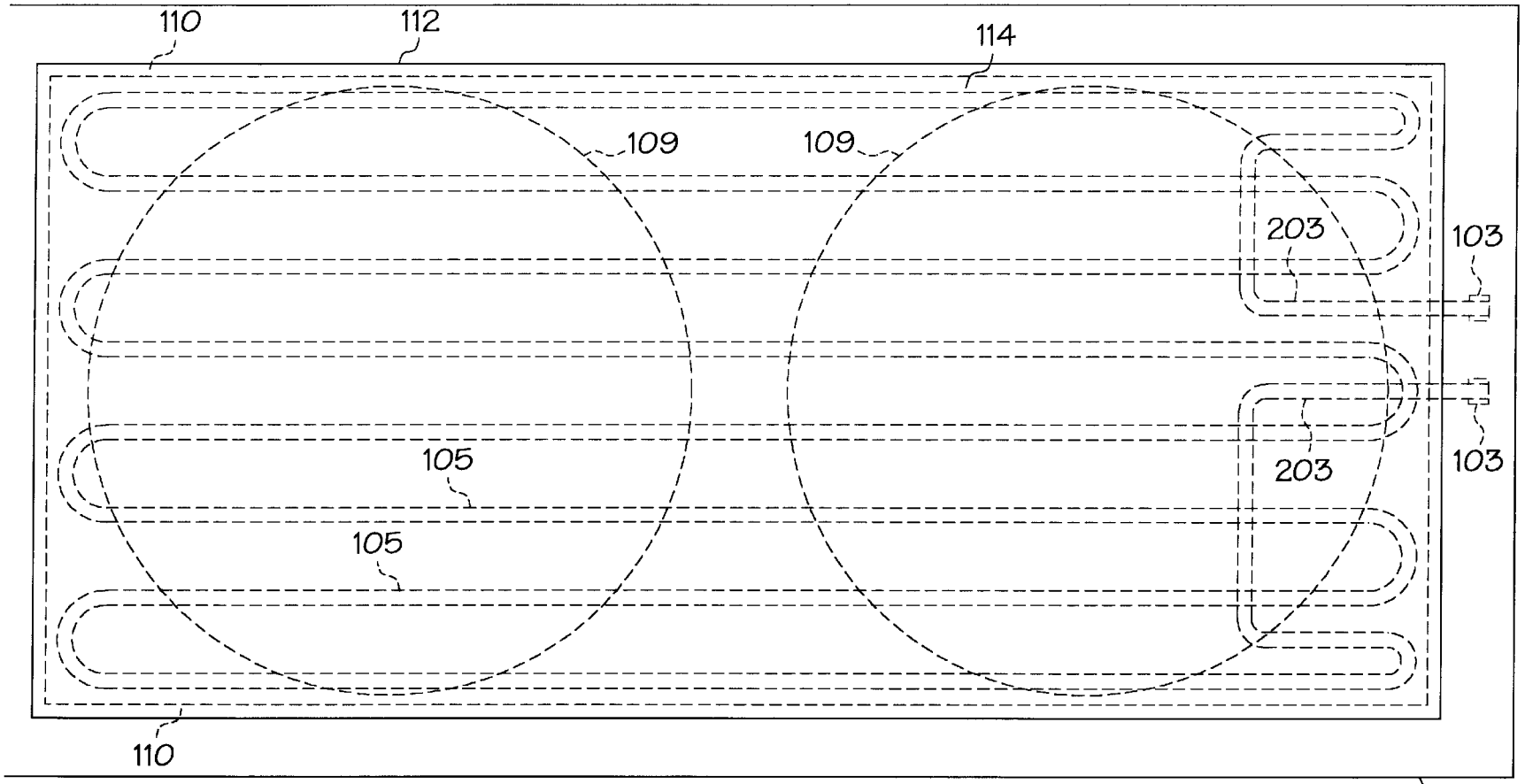
FIG. 4 is a perspective view of upward facing side of FIG. 3.

Referring to FIGS. 3 and 4, a side and top view of a preferred embodiment of the burner apparatus 200 of the present invention depicted as a griddle with a non-stick or stainless steel cooking surface 114 as it would be situated on the electric range surface 109. An electric heating element 105 is encased between the planer cooking surface 114 and lower surface 230, in a longitudinal direction, with lead-ins 203, and connecting prongs 103 attached, extending down and to the side to connect the electric heating element 105, to the electric range, not shown. The burner apparatus 200 has a raised edge 112 around the entire perimeter of the cooking surface 114 to help keep food and liquids on the cooking surface 114. A magnetic strip 110 is attached to the bottom surface 230 at the peripheral side 231 so as to secure the griddle in place on the range surface 109 and protect the range interior area 2 from spills. As depicted, the burner apparatus 200 is large enough to cover two cooking wells 2 of the range surface 109 and has one electric heating element 105 encased within.

Figure 5:
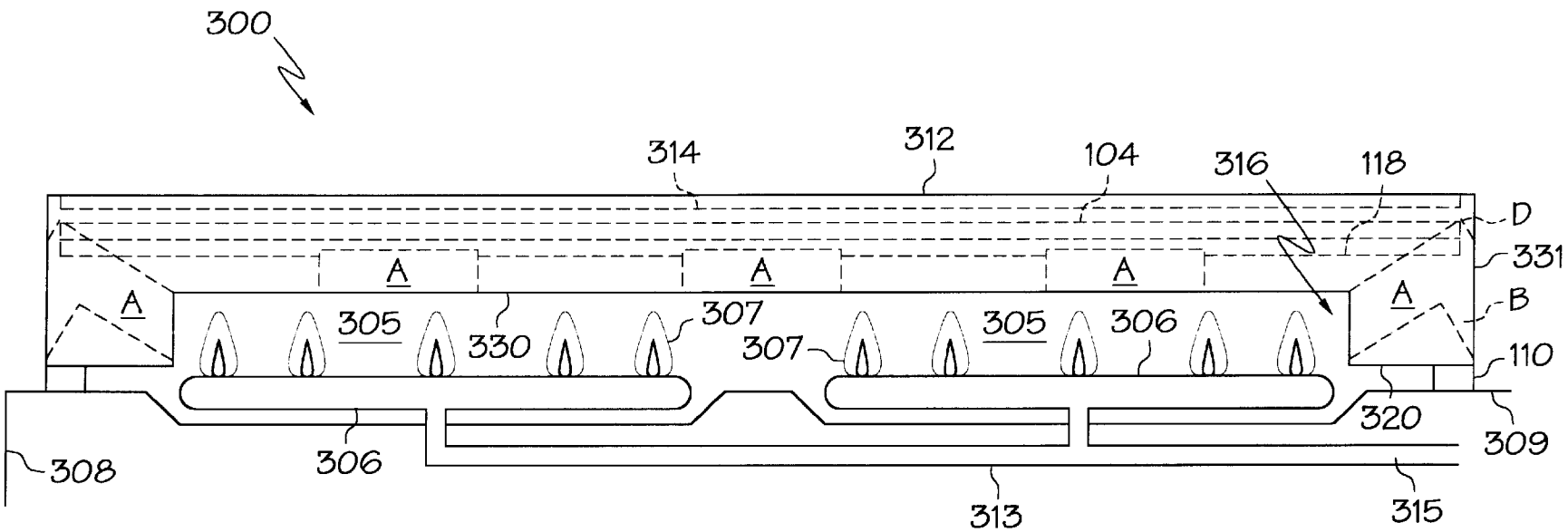
FIG. 5 is a side elevation of another preferred embodiment of the present invention showing the burner apparatus securely situated on the gas range top. Designed as a griddle, the burner apparatus is depicted as covering two gas burner heating elements.
Figure 6:
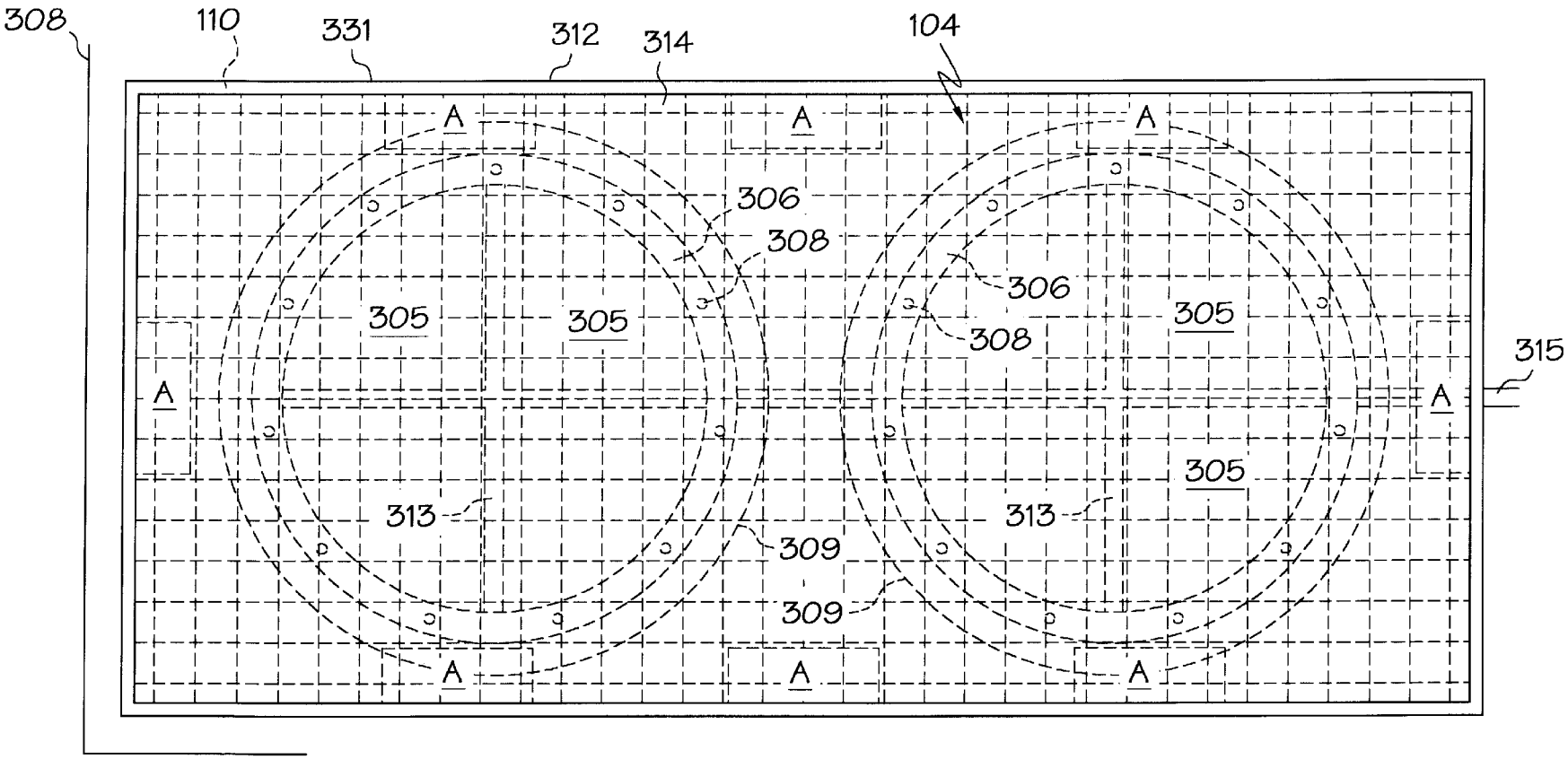
FIG. 6 is a perspective view of the upward facing side of FIG. 5.

Referring to FIGS. 5 and 6, a side and top view of a preferred embodiment of the burner apparatus 300, depicted as a griddle, is positioned on the gas range surface 309, over two gas burner heating elements 306 of the gas range 308. A raised perimeter 312 helps keep the food and liquids on the planer non-stick or stainless steel cooking surface 314. A section 316 with bottom surface 320 is added to the perimeter of burner apparatus 300 and aligned with side 331 so that bottom surface 330 of the burner apparatus 300 is at the correct height over the gas burners 106. Air vents A, with recessed lower section B and pointed section D above, are designed to supply air to the range interior 305 while preventing spills from entering. The air vents A are arranged around the entire perimeter of burner apparatus 300. An upper metal grid 104, having a lower small plate 118 attached, is encased in the burner element 300 between the cooking surface 314 and bottom surface 330 in such a way as to get the heat from the flames 307, to the surface 314, as quickly as possible. A magnetic strip 110 is attached to the bottom 320 at the peripheral edge 331 to secure the burner apparatus 300 to the range surface 309. Gas 315, enters the range gas line 313 and becomes a flame 307, as it exits the gas jets 308 of the range burner element 306 and mixes with the air, in space 305, being supplied by air vents A.

Figure 7:
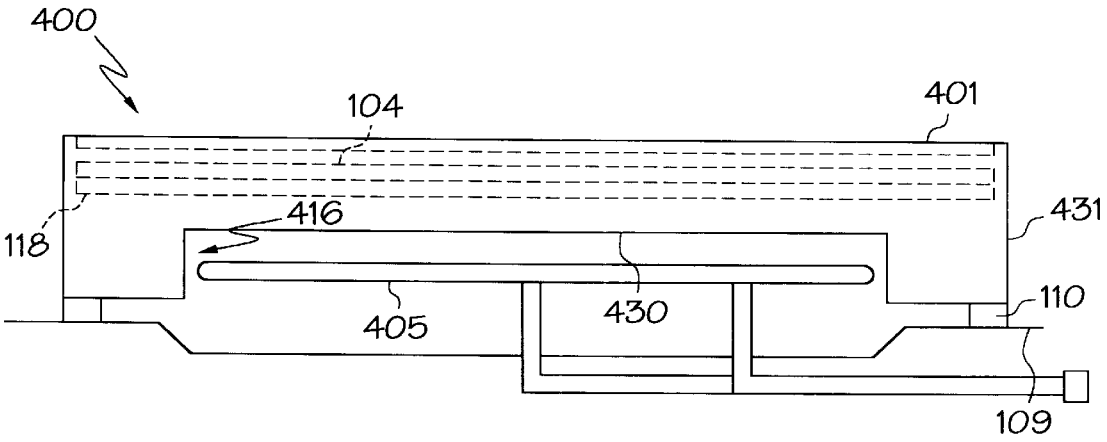
FIG. 7 is a side elevation of another preferred embodiment of the present invention showing the burner apparatus, securely situated on an electric range and positioned over the ranges own electric heating element that will supply the heat for cooking.
Figure 8:
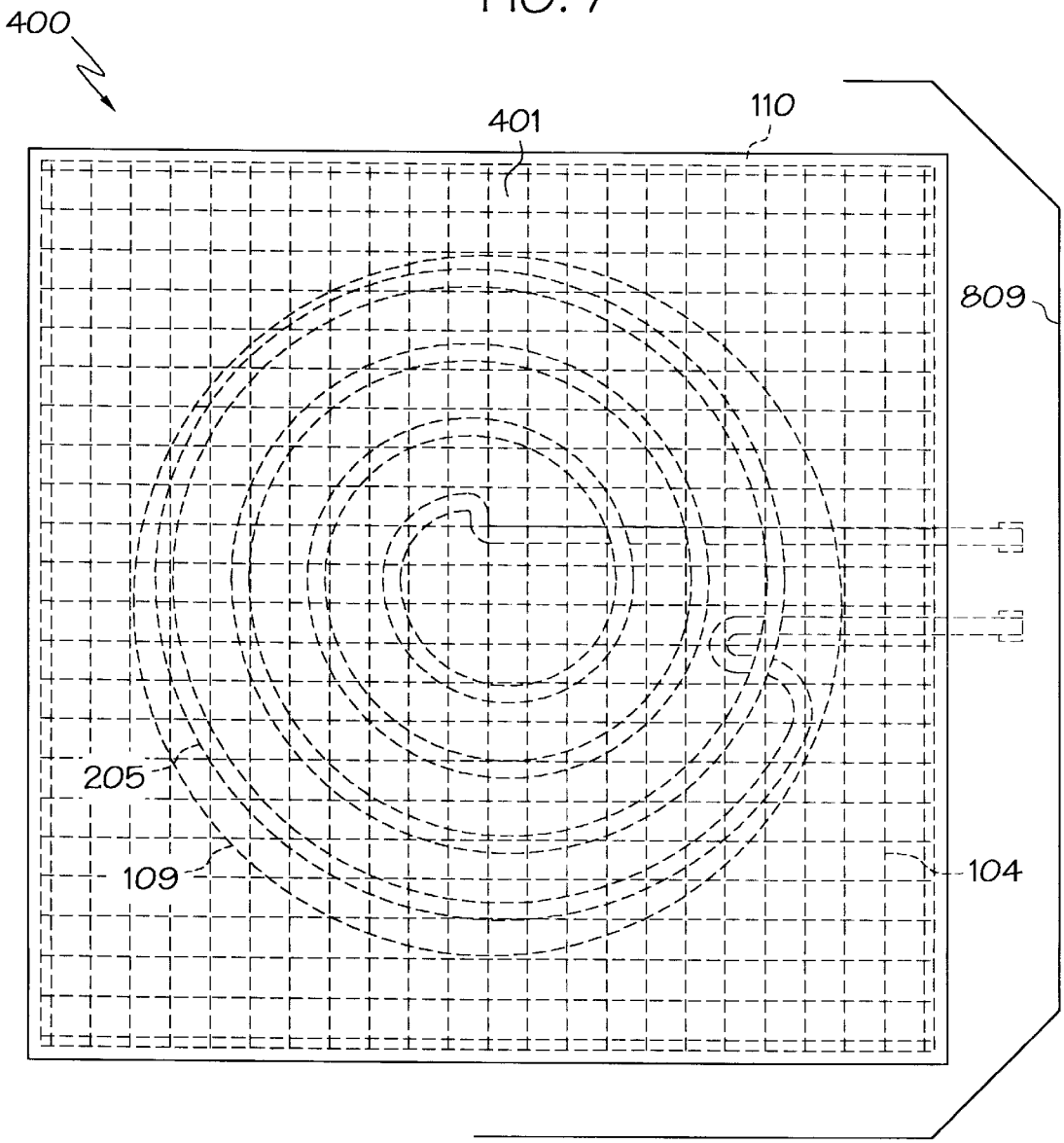
FIG. 8 is a perspective view of the upward facing side of FIG. 7, depicting the burner apparatus as having a square shape and positioned over a single heating element.

Referring to FIGS. 7 and 8, a side and top view of another preferred embodiment of the burner apparatus 400, comprised of an upper planar heating surface 401 and a lower surface 430 and outer edge 431. A metal grid 104, with small plates 118 attached, is encased between the upper planar surface 401 and lower surface 430 in such a way so as to transfer the heat from the electric heating element 405, up to the heating surface as quickly as possible. A section 416 is added to the lower perimeter of bottom surface 430 aligned with an extended outer side 431 so as to position the bottom surface 430, of the burner element 400, at the proper height over the electric heating element 405 of the electric range 809. Burner element 400, depicted as being positioned over one electric heating element 405, can be manufactured larger so as to cover two electric heating elements 405, encompassing one half the range surface 809, or covering four electric heating elements and encompass the entire electric range surface.

Figure 9:
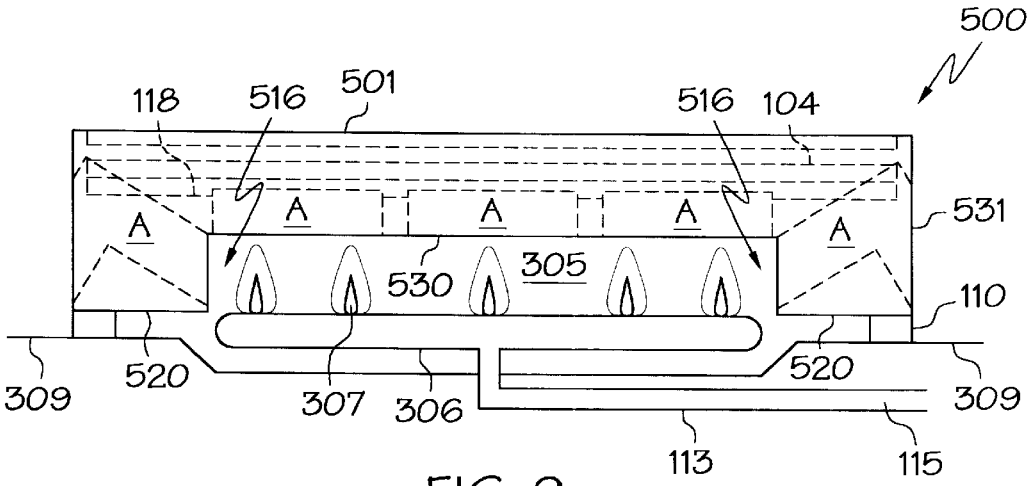
FIG. 9 is side elevation of another preferred embodiment of the present invention showing a burner apparatus securely positioned on a gas range and positioned over the gas heating element of the range.
Figure 10:
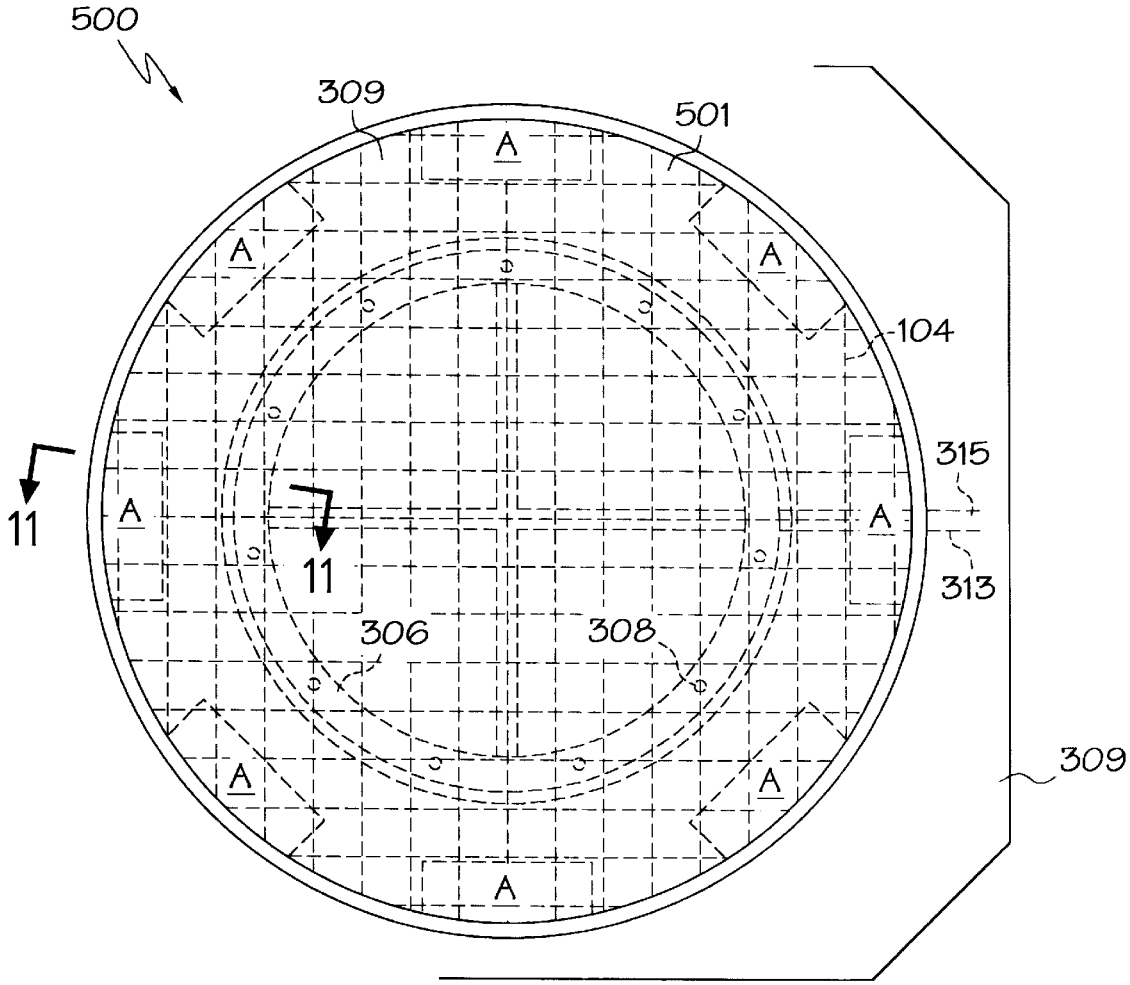
FIG. 10 is a perspective view of the upward facing side of FIG. 9.

Referring to FIGS. 9 and 10, the side and top view of another preferred embodiment of the burner apparatus 500 comprising an upper planar heating surface 501, a lower surface 530 and a metal grid 104, with plates 118 attached, encased between the upper planar heating surface 501 and bottom surface 530 so as to transfer the heat from the gas flame 307 to the top planar heating surface 530 as quickly as possible. A lower section 516 extends downward from surface 530 to surface 520 that is horizontal over to peripheral side 531 so as to position lower surface 530 at the proper height over the gas burner element 506. A metal grid 104, with plates 118 attached, is encased between the upper planar heating surface and lower surface 530 to transfer the heat from the flames 307 to the upper planar heating surface as quickly as possible. Air vents A, are spaced around the perimeter of burner apparatus 500 to supply combustion air to the space 305. Gas 315, enters gas line 313, and becomes a flame 307, as it exits heating element 306 and mixes with air in chamber 305. C—C is a cross section through an air vent A and enlarged in FIG. 11.

Figure 11:
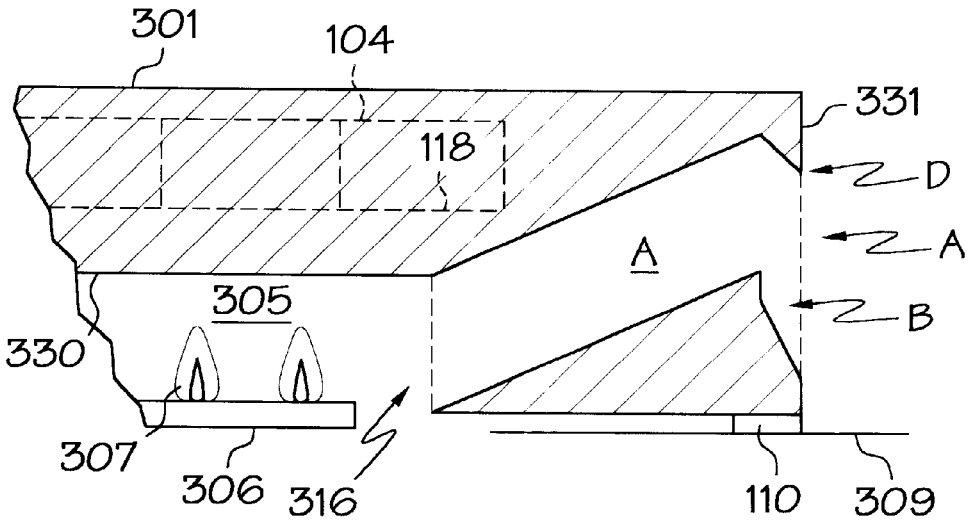
FIG. 11 is a view of cut-away of FIG. 10 denoted as C—C, used to more clearly show the design of the air vents and the section added to the outer, lower perimeter of all burner apparatus that are designed to be used over range gas burners.

Referring to FIG. 11 is a cross section C—C, of burner apparatus 500 in FIG. 10, as used over gas burner 306. It shows how the lower section 316 cooperates with the upper section of burner apparatus 500 to position the height of the bottom surface 330 of the burner apparatus 500 correctly over the gas burner 306. With the added space provided by section 316, the air vents A can adequately supply air to the space 305 to be used as combustible air for burning the gas 315 supplied by burner element 306. Air vents A, having a recessed bottom section B and a pointed upper lip D, so that air can enter the range interior 305 through air vent A and spills are prevented from entering the range interior 305. The upper metal grid 304 with lower plates 318 attached, are encased between the planer surface 301 and the lower surface 330 and the magnetic strip 110, positioned on the bottom outer perimeter of section 316, attaches the burner apparatus 500, securely on the range surface 309. Range apparatus 300 air vents A are designed the same as depicted here.

In the preferred embodiment of burner apparatus 200 and 300, depicted as a griddle, with an anti-stick coating, applied to the cooking surface to prevent food from sticking, polymers of tetrafluoroethylene, copolymers of tetrafluorethylene and hexafluoropropylene (a commercial embodiment of one such coating is offered by RI DuPont de Nemours under the trademark TEFLON) are used.

In the preferred embodiment of burner apparatus 100, 200, 300, 400 and 500 the body is formed from a material good heat transfer ability, such as ceramic, glass-ceramic or porcelain-ceramic. However it should be understood that other high temperature materials typically used for stove covers, hot plates and the like may be used and if a new product that hasn't been published yet is made public, they may be incorporated in the burner apparatus of our invention.

In another preferred embodiment of the invention, the burner apparatus 100, 200, 300, 400 and 500 may be provided with a conventional temperature control, having a temperature sensor, such as a temperature variable resistor (a platinum wire resistor), a thermistor, or a thermocouple, for controlling the amount of heat which the burner apparatus imparts to food or a cooking vessel resting thereon. The controller may also include a potentiometer, a rheostat, a semi-conductor assembly, and or the like which can control the amount of electricity being supplied to the electric heating element or control the amount of gas to the gas burner heating element, there-by controlling the intensity of the flame.

It should be understood that while the figures illustrate a heating element having conventional prong connectors, other forms of connectors may be used without departing from the claimed invention. It should also be understood that an adaptor for attaching the prong connectors to various types and styles of electrical connectors found in ranges may be used.

From the foregoing, it should now be apparent to those skilled in the art that the new and novel burner apparatus of the present invention may be used to replace the burner heating element of a conventional electric range or may be used in conjunction with the burner heating elements of the electric range. It should also be apparent to those skilled in the art that the burner apparatus of the present invention may be formed having various configurations, sizes and colors. It should also be apparent to those skilled in the art that the burner apparatus of the present invention provides a substantially even and smooth cooking surface that can be used to support a cooking vessel or permits the user to heat or cook a variety of foods directly on the upper heating surface without the need of a cooking vessel. It should now be apparent that the burner apparatus of the present invention provides a surface that is relatively easy to clean and reduces or prevents liquid of food from entering the interior regions of the range.

There has been provided a new and novel burner apparatus for use with electric or gas ranges, that is relatively easy to clean and maintain, that can provide a heating surface that can accommodate various sizes of cooking vessels, permits the cooking of certain foods without the use of cooking vessels; is relatively inexpensive to manufacture and maintain, relatively durable, simple in construction and easy to install on conventional ranges.

Although this invention has been shown and described with respect to detailed embodiments thereof; it will be understood by those skilled in the art that various changes in for and detail may be made without departing from the spirit and scope of the claimed invention.

What is claimed:

1. A burner apparatus, for use with a cooking stove, comprising:

a body having an upper planar heating surface and a lower surface; and a magnet for securing the burner apparatus in position on the cooking stove; wherein said upper planar heating surface has a smooth and even configuration.

2. The burner apparatus of claim 1 further comprising at least one heating element disposed between said upper planar heating surface and said lower surface.

3. The burner apparatus of claim 1 is formed of a heat transferring material.

4. The burner apparatus of claim 1 wherein said body is selected from the group comprising ceramic, glass-ceramic and porcelain-ceramic.

5. The burner apparatus of claim 1 wherein said upper planar heating surface is coated with an anti-stick material.

6. The burner apparatus of claim 1 further comprising means for regulating the temperature of the upper surface of said burner apparatus.

7. The burner apparatus of claim 1 further comprising a metal grid for transferring heat across said upper planar heating surface of said burner apparatus.

8. The burner of claim 2 wherein said heating element comprises means for attaching to an electrical range.

9. A burner apparatus for use with a electric range having at least one opening formed along the top surface of the range, said burner apparatus comprising;

a body having an upper planar heating surface and a lower surface; and a heating element disposed between said upper planar heating surface and said lower surface;

said lower surface having magnetic means for supporting said burner apparatus and for securing said burner apparatus to the top surface of the range;

wherein said body is formed of a heat transferring material; and wherein said upper planar heating surface is substantially smooth and even.

10. The burner apparatus of claim 9 wherein said material is selected from the group comprising ceramic, glass-ceramic and porcelain-ceramic.

11. The burner apparatus of claim 9 wherein said upper planar heating surface is coated with an anti-stick material.

12. The burner apparatus of claim 9 further comprising a grid as means for improving heat transfer across said body and for providing an even heat distribution across said upper planar heating surface.

13. The burner apparatus of claim 9 wherein a peripheral edge of said upper planar heating surface includes a lip.

14. The burner apparatus of claim 9 further comprising means for regulating the temperature of the upper surface of said burner apparatus.

15. A burner apparatus for use with a gas stove having at least one opening formed along the top surface of the stove and a flame holder for providing a heating flame, said burner apparatus comprising:

a body having an upper planar heating surface and a lower surface and a section around the perimeter of the body and extending downward;

said section having a magnetic means for supporting said burner apparatus and for securing said burner apparatus to the top surface of the stove and for providing a gap between said lower surface and the heating flame; and a plurality of air vents for venting said gap;

wherein said upper planar heating surface provides a smooth and even surface.

16. The burner apparatus of claim 15 further comprised of Ceramic, glass-ceramic or porcelain-ceramic.

17. The burner apparatus of claim 15 wherein said upper planar heating surface is coated with an anti-stick material.

18. The burner apparatus of claim 15 further comprising a grid means for improving heat transfer across said body and for providing an even distribution across said upper planar heating surface.

19. The burner apparatus of claim 15 wherein a peripheral edge of said upper planar heating surface includes a lip.

20. The burner apparatus of claim 15 further comprising a means for regulating the temperature or the upper surface of said burner apparatus.

21. The burner apparatus of claim 15 wherein said air vents are inclined upwardly through said body and inclined obliquely downwardly into said gap.

* * * * *